United States Patent [19]

Gabriëls

[11] 3,934,513

[45] Jan. 27, 1976

[54] GRENADE-FIRING DEVICE

[75] Inventor: André J. Gabriëls, Genk, Belgium

[73] Assignee: Fabrique Nationale Herstal S.A., Liege, Belgium

[22] Filed: June 17, 1974

[21] Appl. No.: 480,170

[52] U.S. Cl. ..... 102/65.2; 42/1 F

[51] Int. Cl.[2] ..... F42B 11/42; F41C 27/06

[58] Field of Search ..... 42/1 F; 102/65.2

[56] References Cited

UNITED STATES PATENTS

| | | | |
|---|---|---|---|
| 3,491,693 | 1/1970 | Streckfuss et al. | 102/65.2 |
| 3,620,162 | 11/1971 | King | 42/1 F |
| 3,726,036 | 4/1973 | Jennings et al. | 42/1 F |

FOREIGN PATENTS OR APPLICATIONS

| | | | |
|---|---|---|---|
| 605,919 | 1960 | Italy | 42/1 F |

*Primary Examiner*—Charles T. Jordan

*Attorney, Agent, or Firm*—Bacon & Thomas

[57] ABSTRACT

The invention pertains to a device for firing a grenade or similar projectile using a weapon such as a gun, of the type which comprises a tubular case affixed to the rear of the grenade, a bullet trap being inserted into the said tube, said trap consisting of a steel mass, subcalibrated to correspond to the said tube and having, near each of its ends, one or more centering edges resting on the inner wall of the said tube, or on a corresponding portion of the body of the grenade.

4 Claims, 2 Drawing Figures

GRENADE-FIRING DEVICE

Figure 1:
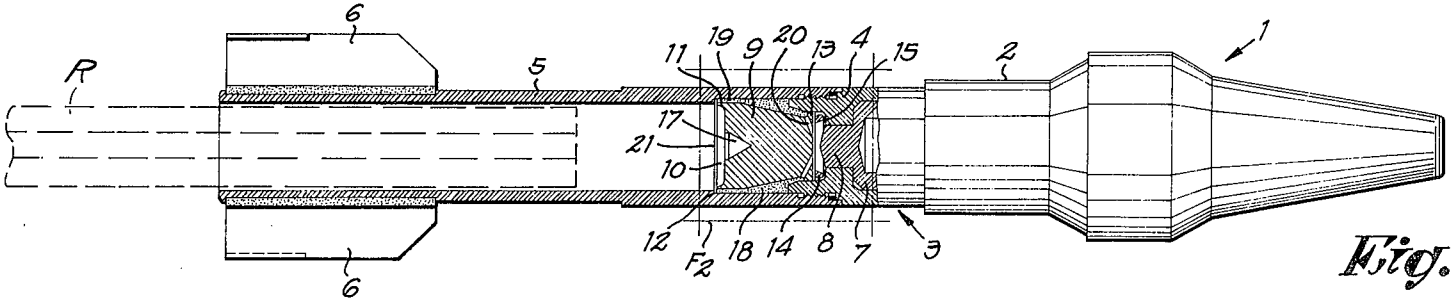

This invention concerns a device for firing a grenade or similar projectile at the end of the barrel of a weapon such as a gun.

Various designs have already been proposed for the type of device in which the energy necessary for launching the projectile is produced by the use of special or blank ammunition, or of bullets such as are generally used in the weapon envisaged.

The invention concerns principally, but not exclusively, a firing device of the latter type.

More specifically, the invention concerns a bullet trap for use in this type of device, the main purpose of which is to prevent the bullet from damaging the grenade when fired.

In one particular form of the device, according to the invention, the firing can also be done through the use of blank or non-bullet ammunition.

There have already been various types of bullet trap proposed, consisting of a mass of rubber, plastic, felt or similar material. These devices are in general unsatisfactory, at least in cases where the force of the bullet to be stopped exceeds a certain level.

Decelerating tubes have also been proposed, which would contain metallic baffle plates or a liquid, designed in each case to slow the bullet down progressively. Such tubes have the disadvantage of being necessarily long and cumbersome and not being able to accommodate an additional propellant as a supplementary charge. Moreover, they can cause a certain risk to the person firing, since fragments are expelled when the grenade is launched.

The aim of the invention is to provide a device of the type envisaged but without the disadvantages mentioned above.

To this end, a firing device of this type is proposed, comprising a tubular case affixed to the end of the grenade, a bullet trap being inserted into the said tube, the trap consisting of a steel mass sub-calibrated to fit the said tube and having, near each of its ends, one or more centering edges resting on the inner wall of the said tube or on a corresponding portion of the body of the grenade.

The said mass is preferably of the hardest steel obtainable, the degree of hardness being determined by the appearance of cracks in the said mass-cracks which should be avoided if possible.

At its front extremity the said mass rests on any suitable portion of the tubular case or against the edge, with a washer of relatively ductile material, such as copper, coming between as shock absorber. This washer is preferably annular and in the form of a truncated cone.

In one type of construction, the head of the tubular casing can be formed by the rear part of the body of a fuse and by a bolt, moving axially, contained within this fuse. In this case, the above-mentioned washer rests on the body of the fuse and encircles the said bolt.

Figure 2:
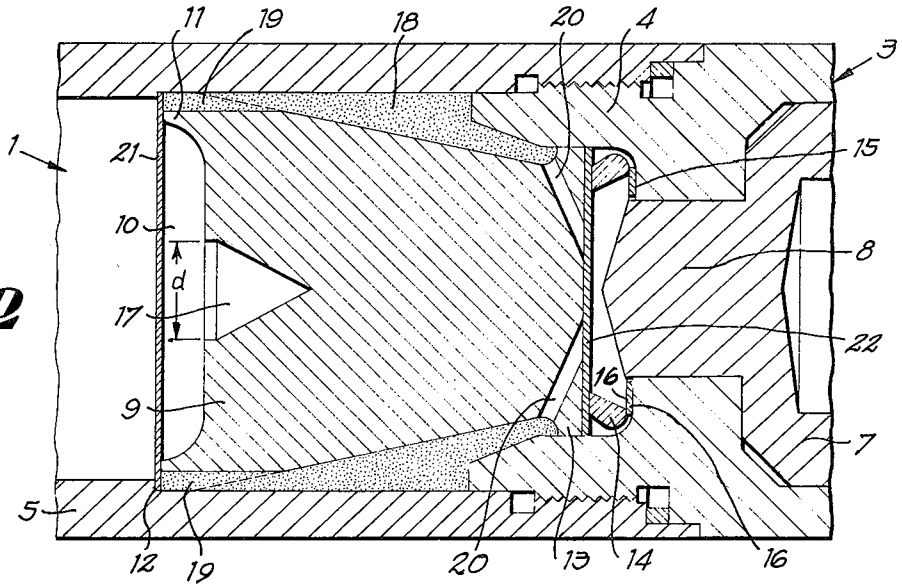

Preferably, a supplementary charge will be included in the said tube, encompassing at least one part of the said mass. The above-mentioned details, and other features and advantages of the invention, will emerge more clearly from the description of one method of construction which is given below by way of example, though not binding in all details; it relates to the annexed diagrams, in which:

FIG. 1 shows a partial and diagrammatic cross-section of a grenade fitted with the device according to the invention; and FIG. 2 is a larger-scale view of the section of FIG. 1 marked F2.

The whole model represented, which is designed for use with an army rifle as shown schematically at R, is composed of a grenade 1, the body of which is extended at the rear by a fuse 3, the body of which is likewise extended by a tubular case (5) fitted with four stabilizing blades 6 and adapted to fit over the barrel of rifle R.

In this example, the fuse 3 contains a bolt 7, which moves axially and one part of which 8 protrudes at the rear into a hollow section in the body 4 of the fuse 3.

The bullet trap, according to the invention, is composed of a steel mass 9, in this case a truncated cone in form, the broad base of which is placed towards the rear of the tube 5. This broad base contains a circular hollow section 10, leaving an annular rim 11. This rim rests against a shoulder 12, included for this purpose in the tube 5, when the device is at rest.

The mass 9 has, at its narrow end, a radial, annular projecting piece 13 which fits into the aforesaid hollow section of the body 4.

A copper washer 14 is placed between the narrow end of the mass 9, or its projecting piece 13, and the mouth 15 of the said hollow section. This washer serves as a shock absorber. It is annular and of conical tendency in shape.

A slight supplementary cushioning effect can be achieved by making the free end of section 8 of the bolt 7 conical in shape.

A washer 16 of elastic material — for instance felt — is placed at the opening of the body 4 to take up the tolerances of construction.

To reduce the increase in diameter of the mass 9 on penetration by the bullet, a conical blind hole 17 is provided at the rear of the mass, this hole opening into the aforesaid hollow section 10. The diameter d of the entrance to this hole is similar to the calibre of the bullet used.

This hole 17 also has the effect of reducing — if not completely eliminating — the projection of lead backwards on impact by the bullet.

It is preferable to provide a supplementary charge 18 in the tube 5, around at least part of the mass 9. Shafts 19 in the annular rim 11 enable the propulsive gases to reach the said supplementary charge 18, whilst vents 20 enable the gases to escape at the front of the mass 9. These gases help to actuate the bolt 7, by moving it axially.

Discs 21 and 22, of paper or another combustible material, are placed at the two ends of the steel mass 9 and delimit the volume available for the supplementary charge 18.

As stated above, the steel selected for the mass 9 will be as hard as possible, the degree of hardness being determined by the appearance of cracks in the mass. It is thus easy to determine the hardness through experimentation.

It is clear that other designs could also be envisaged, in which the said trap would be immobile in relation to the tube 5, the bolt 7 then being actuated solely by the movement of the gases. In this case, the free end of section 8 of the bolt 7 must not be conical in tendency.

What I claim is:

1. A device for firing a grenade or the like from a weapon such as a gun, comprising: a tube affixed to the rear of the grenade, a bullet trap in the said tube, said trap comprising a steel mass, dimensioned to correspond to the said tube and having, near each of its ends, at least one centering edge resting on at least one of the inner wall of the said tube and a portion of the body of the grenade; a supplementary propellant charge in said tube adjacent said mass, the said mass being provided with vent passages, enabling a propelling gas from a gun to pass from the rear of the said mass to the said supplementary charge and, from there, to the front of the said mass.

2. A device for firing a grenade or the like from a weapon such as a gun, comprising: a tube affixed to the rear of the grenade, a bullet trap in the said tube, said trap comprising a steel mass, dimensioned to correspond to the said tube and having, near each of its ends, at least one centering edge resting on at least one of the inner wall of the said tube and a portion of the body of the grenade, the front portion of the said mass resting on one of a suitable section of the said tube and the grenade, with a washer of ductile material, such as copper, placed therebetween.

3. A device according to claim 2, characterized by the fact that the said washer is annular and essentially conical in tendency.

4. a device for firing a grenade or the like from a weapon such as a gun, comprising: a tube affixed to the rear of the grenade, a bullet trap in the said tube, said trap comprising a steel mass, dimensioned to correspond to the said tube and having, near each of its ends, at least one centering edge resting on at least one of the inner wall of the said tube and a portion of the body of the grenade, said mass being essentially a truncated cone in shape having its broad base placed towards the rear of the said tube.

* * * * *

PO-1050
(5/69)

UNITED STATES PATENT OFFICE
CERTIFICATE OF CORRECTION

Patent No. 3,934,513 Dated January 27, 1976

Inventor(s) ANDRE J. GABRIELS

It is certified that error appears in the above-identified patent and that said Letters Patent are hereby corrected as shown below:

On the title page of the above patent, Column 1, following Item [21] insert:

Foreign Application Priority Data

September 13, 1973 Belgium..... 53,052

Signed and Sealed this
twenty-ninth Day of June 1976

[SEAL]

Attest:

RUTH C. MASON
*Attesting Officer*

C. MARSHALL DANN
*Commissioner of Patents and Trademarks*